United States Patent [19]

Chandler et al.

[11] 4,167,128

[45] Sep. 11, 1979

[54] APPARATUS FOR IMPARTING TORSION TO A TUBULAR MEMBER

[75] Inventors: Arthur R. Chandler; Victor Moody, both of Suffolk, England

[73] Assignee: Weatherford/Lamb, Inc., Houston, Tex.

[21] Appl. No.: 896,278

[22] Filed: Apr. 14, 1978

[51] Int. Cl.[2] ..... B25B 13/52

[52] U.S. Cl. ..... 81/66 R; 74/144

[58] Field of Search ..... 81/66 R, 69, 67 R, 354; 74/144, 156, 165

[56] References Cited

U.S. PATENT DOCUMENTS

| | | | |
|---|---|---|---|
| 805,913 | 11/1905 | Hill | 81/66 R |
| 967,651 | 8/1910 | Maitrugue | 81/354 |
| 1,794,450 | 3/1931 | Duncan | 81/66 R |

FOREIGN PATENT DOCUMENTS

| | | | |
|---|---|---|---|
| 578972 | 4/1944 | United Kingdom | 81/66 |

*Primary Examiner*—Samuel Scott
*Assistant Examiner*—G. A. Anderson
*Attorney, Agent, or Firm*—Fulbright & Jaworski

[57] ABSTRACT

An apparatus for imparting torsion to a tubular member, including a body member, an arm member, a saddle member, and a loop means such as a chain. Torsion is imparted to the tubular member by inducing tension into the chain entrained around the tubular member so that the tubular member is brought to bear against the body member or dies in the body member. A variety of configurations of the apparatus are possible, permitting adjustment to accept different diameter tubular members and assuring maximum positive load reaction.

5 Claims, 2 Drawing Figures

APPARATUS FOR IMPARTING TORSION TO A TUBULAR MEMBER

BACKGROUND OF THE INVENTION

1. Field of the Invention

This invention relates to the field of apparatus and methods for imparting torsion to tubular members. More particularly, it relates to apparatus and methods for rotating, spinning, or applying torque to tubular members such as pipe, collars, tubing, and casing.

2. Description of Prior Art

Applicant is aware of the following prior art which is deemed material to the examination of this application and which is the closest prior art of which the applicant is aware: U.S. Pat. No. 3,892,140; U.S. Pat. No. 3,906,820; and Houston Engineers H-E Multi Grip Breakout Chain Tong described in the 1974 edition of the composite Catalogue of Oil Field Equipment & Service, Volume 2, at page 2697. The rotary drive apparatus of U.S. Pat. No. 3,892,140 is a mechanical casing tong in which rotational torque is applied to a cylinder by means of a tensioned, motor-driven chain and a series of rollers. The subject matter of U.S. Pat. No. 3,906,820 ('820) is an apparatus and method for mechanically spinning pipe used in oil wells. The '820 apparatus also employs a motor-driven chain and a series of rollers. The Houston Engineers chain tong is a typical example of the many prior art tongs. It is a manually operated breakout tool comprising a lever arm, a chain, and a pivotable body. None of the above-mentioned prior art apparatuses claims or suggests the adjustability features of the present invention which assure maximum positive load reaction at specified positions and which teach a method of reacting the load directly through the thickness of the chain.

SUMMARY OF THE INVENTION

The present invention provides a unique apparatus for imparting torsion to a tubular member. It includes a body member to which are pivotally connected an arm member and a saddle member. A loop means, such as a metal chain, for entrainment around the tubular member, is connected at one end to the arm member. The other end of the loop means is securable to the body member after the loop means has been entrained around the tubular member. The body member has a first end, a second end, a midsection, and a plurality of pivot apertures in the midsection. At one end of the arm member a pivot block is formed which has therein a plurality of pivot apertures that permit the arm member to be secured pivotally to the midsection of the body member. Also, the body member has a plurality of locating pin apertures in its first end. The saddle member has a pivot end and a pinion end. The pivot end of the saddle member has therein a plurality of locating pin apertures which permit the saddle member to be pivotally secured to the first end of the body member in a variety of configurations. The pinion end of the saddle member is securable to the midsection of the body member. Dies may be secured to the body member to enhance torque reaction. By utilizing various locating pin aperture positions for the saddle member the angle of the saddle member can be predetermined to ensure that the resultant chain load at center-line of the tubular member passes through the die location. Reaction loads between the tubular member and saddle member are then taken directly through the thickness of chain. This reduces the overall width of the apparatus, since no special reaction positions are required. By utilizing the various pivot holes for the arm member, the chain end loads may be maintained at a sufficiently high magnitude to ensure full torque reaction over a range of tubular member diameters. The chain or metal loop can be made up of removable links or pieces so that chain length or loop length can be adjusted to conform to tubular members of various diameters.

In a typical use of the apparatus, the chain is secured around a tubular member such as a drill pipe. Tension is induced in the chain by external application of a shearing force to the arm member which acts as a lever arm whose fulcrum is located at a point on the body member. The chain (and dies if they are provided) therefore produce a tangential shear at the outer surface of the pipe, thus causing a torque to be applied to the pipe.

It is therefore an object of the present invention to provide an improved apparatus for imparting torsion to a tubular member wherein an arm member is pivotally connected to a body member, a saddle member is connected to the body member, and a loop means for entrainment around the tubular member is connected at one end to the arm member and is connectable at the other end to the body member.

A further object of the present invention is the provision of such an apparatus wherein the arm member may be pivotally connected to the body member at a variety of locations so that mechanical advantage may be maximized and tubular members of different diameters accommodated.

Another object of the present invention is the provision of such an apparatus wherein the saddle member may be connected to the body member in a variety of configurations so that no special reaction positions are required; so that the saddle member presses against the loop means thereby assisting in its tight engagement of the tubular member and preventing its slippage on the tubular member; so that the necessary overall width of the apparatus is reduced; so that resultant loop means load at tubular member center line passes through certain locations, such as the die locations; and so that reaction loads between the tubular member and saddle member are taken directly through the thickness of loop means locally in compression.

DESCRIPTION OF THE PREFERRED EMBODIMENT

Figure 1:
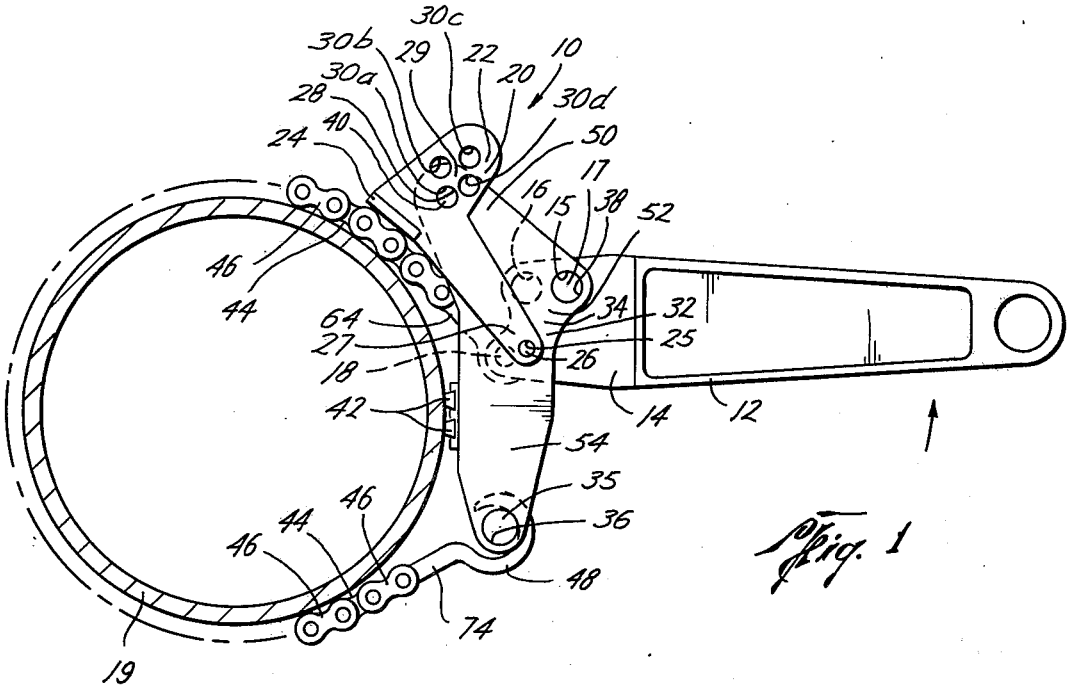
FIG. 1 is a plan view of the apparatus in place around a tubular member and operatively attached thereto.
Figure 2:
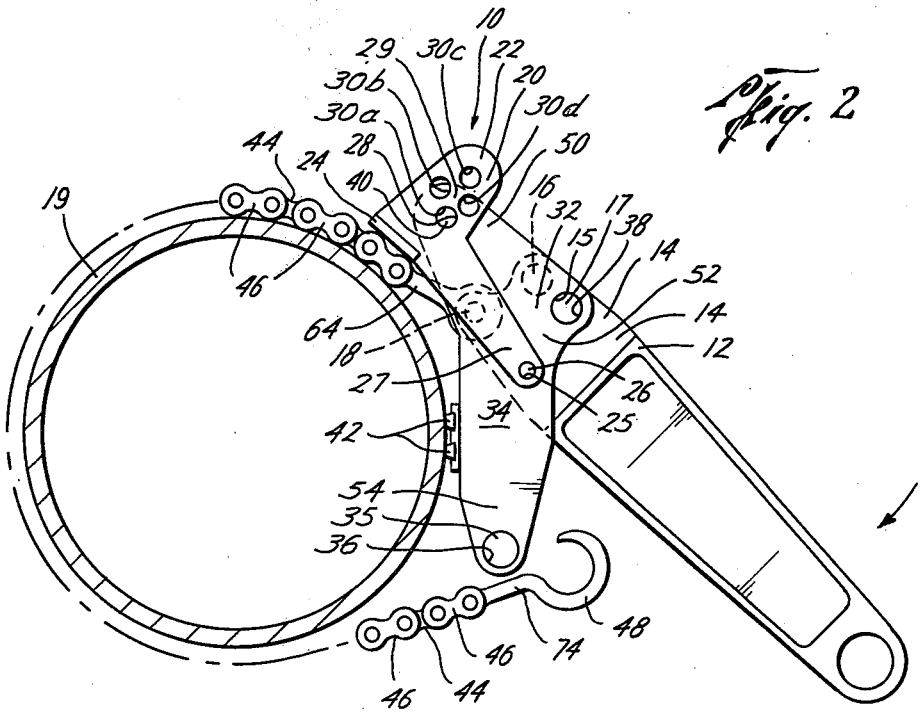
FIG. 2 is a plan view of the apparatus in place about a tubular member.

Referring now to FIGS. 1 and 2 of the drawings, the preferred embodiment of the present invention is represented generally by the reference numeral 10. The apparatus 10 comprises a body member 32, an arm member 12 pivotally connected to the body 32, a saddle member 20 connected to the body 32, and a loop means 44 connected at one end to the arm member 12.

The body member 32 includes of two substantially aligned and parallel body plates 34, spaced apart by the arm member 12. The body member 32 has a first end 50, a midsection 52 and a second end 54. Hence each body plate 34 has a corresponding first end 50, a midsection 52 and a second end 54. A die 42 may be attached to the side of the body member 32 facing the exterior surface of the tubular member 19 to which the apparatus 10 is applied.

The saddle member 20 is comprised of two substantially aligned and parallel saddle plates 22 spaced apart by the body member 32. The saddle member 22 has a pinion end 29 and a pivot end 27; hence, each saddle plate 22 has a corresponding pinion end 29 and pivot end 27. The saddle plates 22 are connected by the plate 24.

The arm member 12 has a pivot block 14 formed at one end.

The loop means 44 may be made up of chain links 46 as shown in FIGS. 1 and 2. The loop means has a pivot block end 64 and a body member end 74. The body member end 74 is formed to provide a suitable detachable securing means 48, such as a hook, so that the body member end 74 is securable to the second end 54 of body member 32.

The pinion ends 29 of the saddle plates 22 of the saddle member 20 can pinioned to the body plates 34 of the body member 32 in a variety of configurations. This is made possible through the selection of locating pin apertures 30*a*, 30*b*, 30*c*, and 30*d* provided in the saddle plates 22 and locating pin apertures 28*a* and 28*b* (2 holes) in the first end 50 of the body plates 34 of the body member 32. In operation the selected saddle plate locating pin aperture—either 30*a*, 30*b*, 30*c*, or 30*d*—is aligned with the locating pin apertures 28*a* or 28*b* of the body plates 34 so that the securing pin 40 can be inserted through both saddle plates 22 and both body plates 34. In FIGS. 1 and 2, securing pin 40 extends through locating pin apertures 28*a* or 28*b* and locating pin apertures 30*a* to pivotally secure the pinion end 29 of the saddle member 20 to the first end 50 of the body member 32. Other locating pin apertures 30*b*, 30*c*, and 30*d* in the pivot ends of the saddle plates 22 can be utilized by aligning the aperture selected with locating pin apertures 28 of the body plates 34 and inserting the securing pin 40 therethrough.

The pivot end 27 of each saddle 22 is pivotally secured to its corresponding body plate 34 at pivot aperture 25. Pivot apertures 25 extend through each saddle plate 22 and body plate 34 and, as shown in the drawings, pivot aperture 25 through each has a common axis. A pivot means 26 pivotally secures together each pivot end 27-body plate midsection 52 pair.

The pivot aperture 38 extends through the midsection 52 of each body plate 34 and pivot apertures 15 and 16 extend through pivot block 14 of the arm member 12. In FIGS. 1 and 2 the securing pin 17 extends through the pivot aperture 38 and pivot aperture 15 to pivotally secure the pivot block 14 of the arm member 12 to the midsection 52 of the body plates 34 of the body member 32. Another pivot aperture 16 of the pivot block 14 can be utilized by aligning the pivot aperture 16 with the pivot aperture 38 of the body plates 34 and inserting the securing pin 17 therethrough.

The pivot block end 64 of the loop means 44 is rotatably secured to the pivot block 14 of the arm member 12 by the securing means 18. In operation, the body member end 74 of the loop means 44 is secured to the body member 32 by attaching securing means 48 to securing pin 35 which extends through the securing pin apertures 36 provided in the second end 54 of each of the body plates 34 of the body member 32.

FIG. 2 depicts the apparatus 10 after the loop means 44 has been entrained around a tubular member, but before the securing means 48 has been attached to the securing pin 35. FIG. 1 depicts the apparatus 10 after the securing means 48 has been attached to the securing pin 35 and the arm member 12 has had a shearing force applied to it so that the loop means 44 has been tightened around the tubular member.

Application of a shearing force to the arm member 12 tightens the loop means 44 around the tubular member 19 and forces the body plates 34 (or, if dies 42 are utilized, the dies 42) into contact with the exterior surface of the tubular member 19 and a tangential shear is produced at the outer surface of the tubular member 19, producing a resulting torque force on the tubular member 19. Selection of an appropriate pivot aperture 15 or 16 makes possible a maximization of mechanical advantage so that the loop means 44 end loads may be maintained at a sufficiently high magnitude to insure full torque reaction over a range of tubular member diameters.

In operation when a shearing force is applied to the arm member 12, the plate 24 of saddle member 20 is forced against the loop means 44, thereby preventing slippage of the loop means on the tubular member the loop means is tensionally loaded, and the dies 42 are forced against the exterior surface of the tubular member 19. The reaction load of the tubular member 19 on the plate 24 is transferred from the saddle member 20 to the body member 32. The locating pin apertures 30*a*, 30*b*, 30*c*, and 30*d* are arranged to insure that the resultant loop means 44 load at the tubular member 19 center line passes through the dies 42. Reaction loads between the tubular member 19 and saddle member 20 are taken directly through the thickness of the loop means 44 locally in compression. Thus the overall width of the apparatus 10 is reduced since no special reaction positions are required which would straddle the loop means 44 width to bear on the tubular member 19.

The present invention, therefore, is well adapted to carry out the objects and attain the ends and advantages mentioned, as well as others inherent therein. While presently preferred embodiments of the invention have been given for the purpose of disclosure, numerous changes in the details of the construction, combination, shape, size and arrangement of parts may be resorted to without departing from the spirit and scope of the invention.

What is claimed is:

1. An apparatus for imparting torsion to a tubular member, comprising, (a) a body member, having a first end, a second end, and a midsection, (b) an arm member, having a pivot block at one end thereof pivotally connected to the midsection of the body member, (c) a saddle member, having a pivot end and a pinion end, the pivot end of said saddle member pivotally connected to the midsection of the body member, the pinion end pinioned to the first end of the body so that upon actuation of the arm member the pinion end of the saddle member contacts the outside of the chain for holding the chain against the tubular member thereby preventing the slippage of the chain.

2. The invention of claim 1 wherein the arm member has a plurality of apertures within the pivot block to provide an adjustable pinion connection of the arm member to the body member.

3. The invention of claim 1 wherein the body member comprises two substantially aligned body plates spaced apart by and pivotally connected to the pivot block therebetween.

4. The invention of claim 1 wherein the saddle member comprises two substantially aligned saddle plates spaced apart by the body member, the two saddle plates supporting a joining plate therebetween and connecting said saddle plates whereby as the pinion end of the saddle plate is urged toward the tubular member the joining plate contacts the loop means.

5. The invention of claim 1 wherein at least one die is positioned on the body member such that said die contacts the tubular member when the body member is urged toward said tubular member.

* * * * *